United States Patent [19]

Bayer

[11] Patent Number: 4,945,619

[45] Date of Patent: Aug. 7, 1990

[54] APPARATUS FOR CONVERTING TUBULAR BLANKS INTO SPACER FRAMES OF MULTIPLE-PANE WINDOWS

[75] Inventor: Franz Bayer, Elzach, Fed. Rep. of Germany

[73] Assignee: Franz Xaver Bayer Isolierglasfabrik KG, Elzach, Fed. Rep. of Germany

[21] Appl. No.: 280,090

[22] Filed: Dec. 5, 1988

[30] Foreign Application Priority Data

Dec. 3, 1987 [DE] Fed. Rep. of Germany ..... 3740921

[51] Int. Cl.[5] ..... B21D 9/15

[52] U.S. Cl. ..... 29/33 R; 29/33 T; 72/298

[58] Field of Search ..... 29/33 R, 33 T; 72/297, 72/298, 309, 310, 369

[56] References Cited

U.S. PATENT DOCUMENTS

| | | | |
|---|---|---|---|
| 3,553,990 | 1/1971 | Juding et al. | 72/298 |
| 4,627,263 | 12/1986 | Bayer et al. | 72/298 |
| 4,660,271 | 4/1987 | Lenhardt | 72/369 |
| 4,720,950 | 1/1988 | Bayer et al. | 52/172 |

*Primary Examiner*—Daniel W. Howell

*Attorney, Agent, or Firm*—Peter K. Kontler

[57] ABSTRACT

Apparatus for converting tubular blanks of ductile material into substantially L-shaped bodies which can constitute parts of spacer frames for use between the panes of multiple-pane windows has a clamping unit which can engage a first portion of a blank so as to locate the blank in a predetermined position in which an intermediate portion of the blank is located between the first portion and a second portion. At such time, one side of the intermediate portion is adjacent a roller and the other side of the intermediate portion is adjacent an anvil. A moving unit is then caused to bend the intermediate portion about the anvil while the distance between the roller and the anvil decreases so that those walls of the intermediate portion which are adjacent the roller and the anvil move nearer to each other during transformation of the intermediate portion into an elbow of the thus obtained L-shaped blank. The dimensions of the roller and anvil are selected in such a way that the mutual spacing of sidewalls of the intermediate portion (such sidewalls alternate with the aforementioned walls) remains unchanged and the elbow assumes an I-shaped cross-sectional outline.

34 Claims, 5 Drawing Sheets

Fig. 4
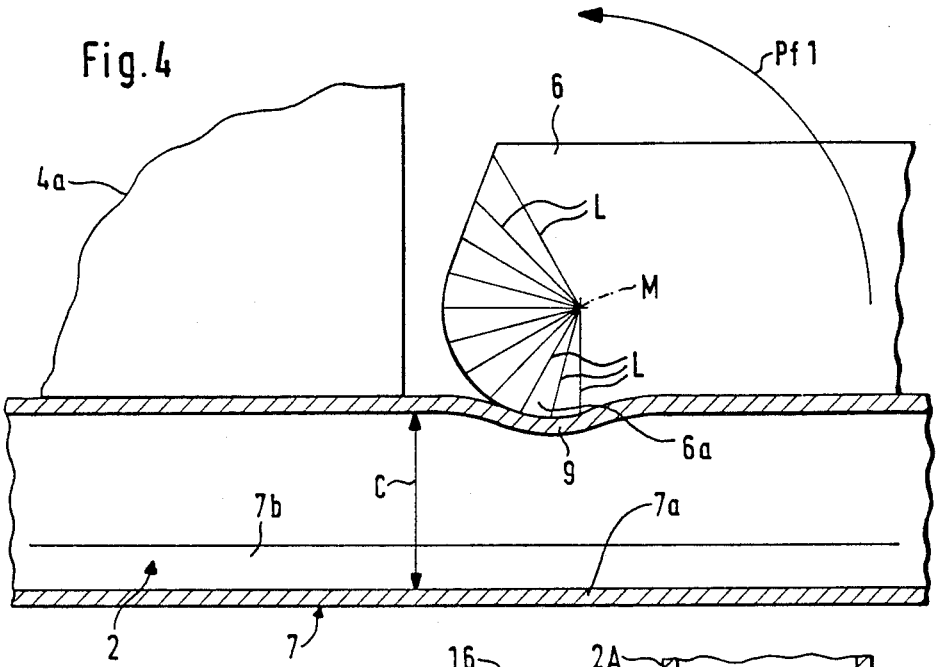
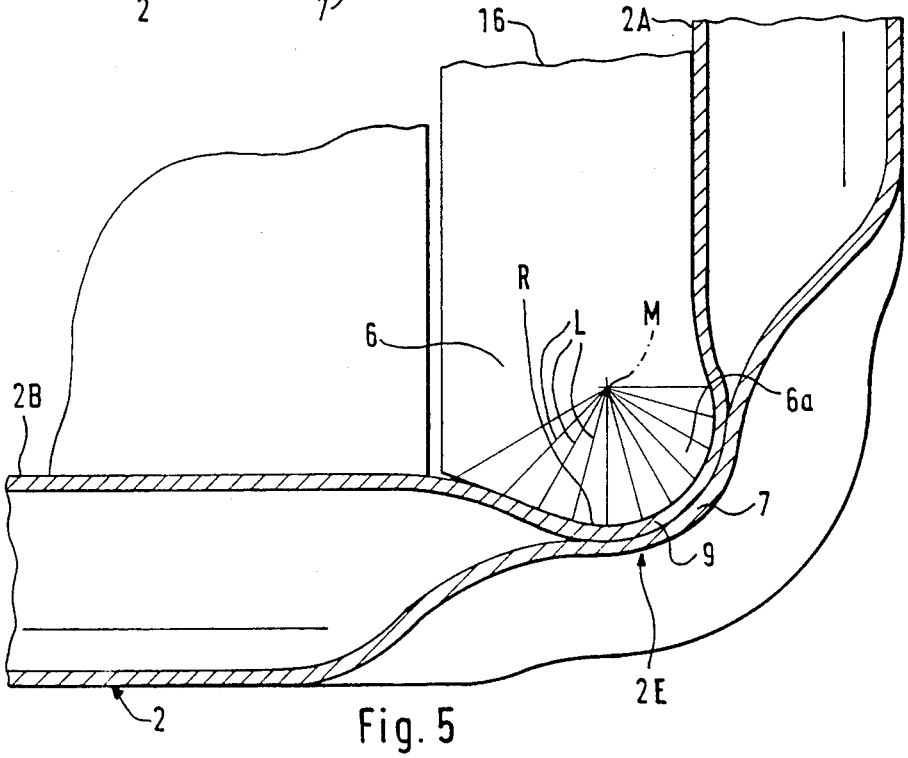
Fig. 5

Fig. 6
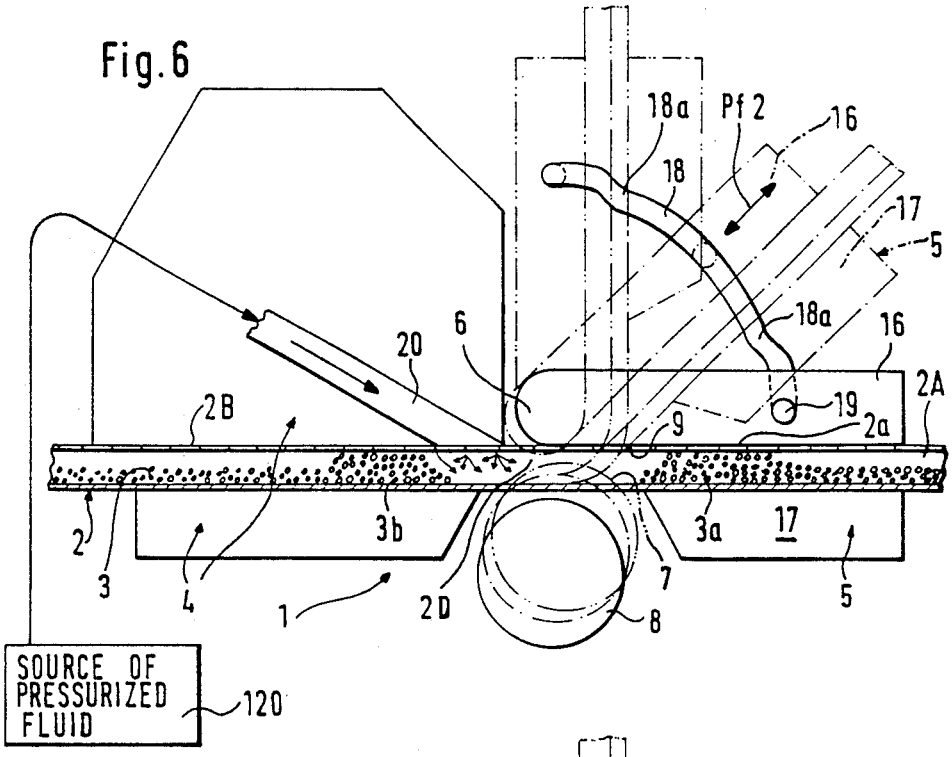
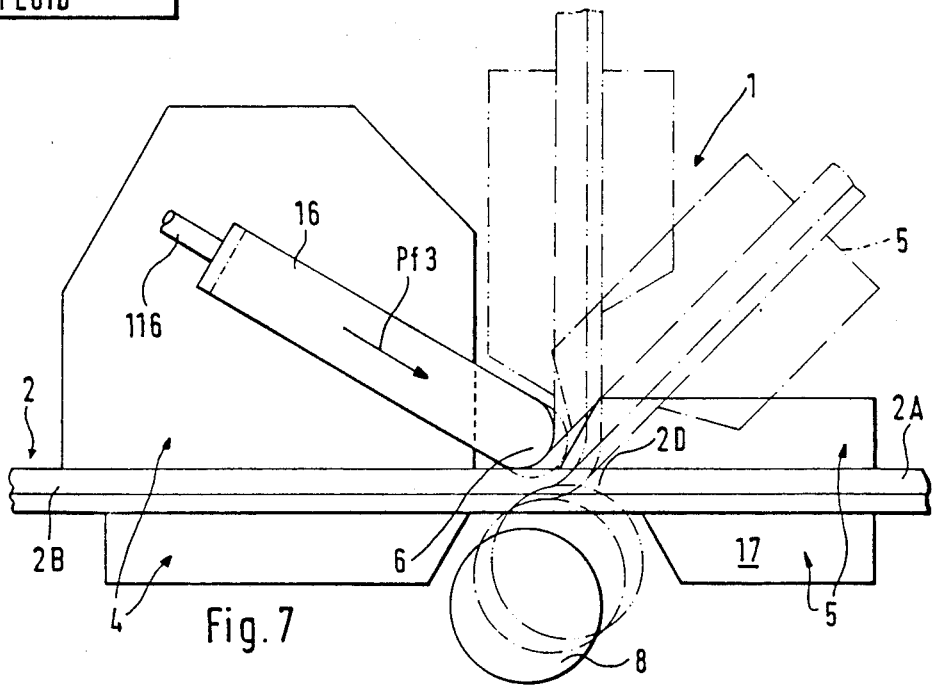
Fig. 7

APPARATUS FOR CONVERTING TUBULAR BLANKS INTO SPACER FRAMES OF MULTIPLE-PANE WINDOWS

CROSS-REFERENCE TO RELATED CASE

The apparatus of the present invention is similar to that disclosed in commonly owned copending patent application Ser. No. 280,401 filed Dec. 5, 1988 by Franz Bayer for "Method of and apparatus for making spacer frames for use in multiple-pane windows".

BACKGROUND OF THE INVENTION

The invention relates to improvements in apparatus for converting tubular blanks of ductile material into spacer frames for use in multiple-pane windows. More particularly, the invention relates to improvements in apparatus for making spacer frames which are or which can be filled with a flowable hygroscopic material (desiccant) serving to absorb moisture which happens to penetrate into the space between the panes of a multiple-pane window so that the moisture cannot cloud the panes to thus affect the light-transmissivity and appearance of the window.

Commonly owned U.S. Pat. Nos. 4,627,263 and 4,720,950 disclose an apparatus wherein intermediate portion of a hollow tubular blank is converted into an elbow (i.e., into a substantially L-shaped or V-shaped body) by bending the intermediate portion around an anvil with assistance from a device which bends the tubular body about the anvil and by resorting to a roller which engages the intermediate portion of the blank opposite the anvil. Such apparatus are quite suitable for the making of satisfactory spacer frames from thick-walled blanks. The roller serves to stretch the material of the adjacent portion of the blank, and the roller can be oscillated at a desired frequency to promote the flow of the material of the blank in the region where the blank is being caused to overlie the anvil.

Problems arise when the walls of the tubular body are thin or very thin. Such tubular bodies are preferred in many instances in order to reduce the cost of spacer frames and of entire windows wherein spacer frames are used to maintain the panes at a given distance from each other as well as to confine a supply of desiccant which absorbs moisture (if any) from the space between the panes. When the walls of the tubular body are very thin, they cannot stand a pronounced rolling operation, i.e., a reduction of wall thickness in addition to that which necessarily takes place as a result of bending an intermediate portion of a tubular blank about an anvil. Attempts to convert thin-walled blanks in accordance with heretofore known procedures have met with failure, primarily because the deforming operation is unpredictable (i.e., the walls develop cracks and/or creases) and also because the number of rejects is excessive. In addition, if the tubular blanks are made of a higher-quality material, such as iron or steel, the material offers a pronounced (and often excessive) resistance to treatment by a roller or the like.

OBJECTS OF THE INVENTION

An object of the invention is to provide a novel and improved apparatus which is constructed and assembled in such a way that it can treat thin-walled and thick-walled tubular blanks with the same degree of predictability and accuracy, which turns out a small number of rejects, and which can be used for satisfactory treatment of blanks consisting of high-, medium- or low-quality, ductile material.

Another object of the invention is to provide an apparatus which can provide tubular blanks with elbows of corners having very small radii of curvature without the development of creases, cracks and/or other defects which would affect the appearance and/or utility and/or useful life of the ultimate products.

A further object of the invention is to provide an apparatus for the making of spacer frames from blanks which are empty or which already contain supplies of desiccant.

An additional object of the invention is to provide the apparatus with novel and improved means for shaping those portions of tubular blanks which are to be transformed into elbows or corners of spacer frames.

Still another object of the invention is to provide the apparatus with novel and improved means for regulating the distribution of desiccant in the blanks.

A further object of the invention is to provide the apparatus with novel and improved means for ejecting converted blanks.

Another object of the invention is to provide an apparatus which is simpler, more compact, more versatile and more efficient but less expensive than heretofore known apparatus.

An additional object of the invention is to provide novel and improved blank deforming devices which can be used in the above outlined apparatus.

A further object of the invention is to provide the apparatus with novel and improved means for locating successive blanks in optimum positions for conversion into substantially L-shaped or V-shaped bodies.

SUMMARY OF THE INVENTION

The invention is embodied in an apparatus for converting an elongated tubular blank of ductile material into a substantially L-shaped body, particularly into a portion of a spacer or spacer frame for use between the panes of multiple-pane windows. More specifically, the apparatus is designed to convert tubular blanks of the type having two spaced-apart walls and two sidewalls alternating with the walls (as seen in the circumferential direction of the blank), disposed at a predetermined distance from each other and having a predetermined width. The improved apparatus comprises means (e.g., a clamping unit with jaws or claws which are movable relative to each other) for locating spaced apart first and second portions of the blank so that an intermediate portion of the blank between the first and second portions assumes a predetermined position, and means for transforming the intermediate portion of the thus located blank into an elbow or corner. The transforming means comprises a first deforming device (e.g., in the form of an anvil) which serves to engage one wall of the intermediate portion in the predetermined position of such intermediate portion, a second deforming device (e.g., a roller) which serves to engage the other wall of the intermediate portion of the properly located blank substantially opposite the first deforming device, means for displacing at least one of the deforming devices toward the other deforming device so that the mutual spacing of the walls between the two deforming devices is reduced to less than the width of a sidewall, and means for moving the first portion of the blank relative to the second portion so as to bend the intermediate portion about the first deforming device. At least one of the devices has a length (as measured transversely of the blank in a direction from one sidewall toward the other sidewall of the properly positioned intermediate portion) less than the predetermined distance so that the elbow which is constituted by the bent intermediate portion of the blank has a profile including a web extending between and being narrower than the sidewalls and two flanges each including one sidewall of the intermediate portion. The profile of the bent intermediate portion can resemble the letter I, H or C.

The displacing means can include means for reducing the distance between the deforming devices to a value such that the walls of the intermediate portion (actually of the elbow) are closely or immediately adjacent or actually touch each other.

If the intermediate portion of a properly located blank contains a supply of flowable hygroscopic material (desiccant), the displacing means is or can be designed to reduce the distance between the displacing devices to a value such that the walls and sidewalls of the intermediate portion of the properly located blank define a flat chamber for desiccant.

In accordance with a presently preferred embodiment of the apparatus, the length of the at least one deforming device (as measured in a direction from one of the sidewalls toward the other sidewall) at most equals the distance between the sidewalls minus 2m wherein m is the thickness of a wall or sidewall, i.e., the wall thickness of the blank.

If the second deforming device includes a roller, the latter preferably comprises a substantially cylindrical central portion and an annular peripheral portion having an axial length which diminishes in a direction radially outwardly from the central portion. The axial length of the central portion approximates the distance between the sidewalls, and the minimum axial length of the annular peripheral portion at most equals the distance between the sidewalls minus 2m.

If the blank is of the type wherein the (other) wall which is to be engaged by the roller has a median portion of predetermined width and two lateral portions which flank the median portion and slope toward the respective sidewalls, the minimum axial length of the annular peripheral portion of the roller can equal or approximate the width of the median portion of the other wall. The width of the annular peripheral portion in the radial direction of the roller preferably exceeds the extent to which the other wall of the intermediate portion of the blank is moved toward the one wall in response to displacement of the at least one deforming device toward the other deforming device.

The first deforming device can be provided with an elongated extension and with an eccentric protrusion which extends laterally beyond one side of the extension. The protrusion serves as a means for providing the intermediate portion of the blank with a recess in response to bending of the intermediate portion about the first deforming device. The latter is preferably exchangeable, the same as the roller, so as to enhance the versatility of the converting apparatus by enabling the two deforming devices to properly transform blanks of the type having sidewalls disposed at different distances from each other as well as to manipulate blanks which are empty or contain supplies of flowable desiccant.

The displacing means can be designed to move the first deforming device toward the second deforming device, and the locating means (such as the aforementioned clamping unit) is preferably placed into immediate or close proximity of the first deforming device. The aforementioned extension of the first deforming device can serve to abut the first portion of the blank during movement of the first portion relative to the second portion of the blank, i.e., during transformation of intermediate portion of the blank into an elbow. Thus, the extension can form part of the means for moving the first portion of a properly located blank. Such moving means can further include a bending element which is disposed opposite the extension (with the first portion of a properly located blank between them) and is movable along an arcuate path about the first deforming device while the first portion of the blank is confined between the extension and the bending element.

The displacing means can be designed to move the first deforming device substantially to the neutral line or chord of the blank in the region between the two deforming devices. The moving means can turn the first deforming device about a predetermined axis which extends at right angles to the planes of the sidewalls to thereby move the eccentric protrusion of the first deforming device nearer to the second deforming device so that the protrusion penetrates into and forms the aforementioned recess in the intermediate portion of the blank.

The elongated extension of the first deforming device can be oriented in such a way that it makes an acute angle with the second portion of the properly located blank, and the displacing means then comprises means for moving the first deforming device in the longitudinal direction of the extension in a direction to reduce the distance between the two deforming devices.

The displacing means can be desigend to move the first deforming device toward the second deforming device during predetermined stages of bending of intermediate portion about the first deforming device, particularly during the initial and final stages of such bending or transforming operation. The displacing means can include a stationary cam, follower means provided on the first deforming device and arranged to track the cam, and means (such as the aforementioned bending element) for moving the first deforming device relative to the cam. The cam can include one or more first portions nearer to and one or more second portions more distant from the second deforming device.

The apparatus can further comprise stops which flank the sidewalls of the intermediate portion during bending of intermediate portion about the first deforming device. The locating means and the transforming means can be mounted on one of the stops, and the apparatus can further comprise means for adjustably mounting the other stop so that the mutual spacing of the two stops can be varied in order to conform to the distance between the outer sides of the sidewalls of a blank which is to be converted into a portion of a spacer frame.

The apparatus can further comprise means for ejecting the L-shaped body from the locating means, and such ejecting means can include one of the deforming devices, particularly the first deforming device.

If the blank contains a supply of flowable desiccant, the apparatus can further comprise means for limiting the quantity of desiccant in the intermediate portion of the blank, e.g., for limiting the quantity of desiccant in the intermediate portion to zero. The limiting means can include a source of pressurized gaseous fluid and one or more nozzles for directing streams of pressurized fluid into the interior of intermediate portion of a properly located blank, preferably through customary openings which are provided in one wall of the blank so as to enable desiccant to absorb moisture which penetrates into the space between the panes of a multiple-pane window. The stream or streams of pressurized fluid expel desiccant from the intermediate portion of the properly located blank, at least during bending of intermediate portion about the first deforming device. The nozzle or nozzles of the limiting or expelling means are preferably adjacent the first deforming device and/or the locating means. The nozzle or nozzles can be arranged to discharge one or more streams of pressurized fluid at an acute angle to the second portion of the properly located blank.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a sectional view, substantially as seen in the direction of arrows from the line IV—IV of FIG. 2, with one of the deforming devices omitted;

FIG. 5 is a sectional view, substantially as seen in the direction of arrows from the line V—V of FIG. 3, with one of the deforming devices omitted;

FIG. 6 is a fragmentary schematic partly elevational and partly sectional view of a second apparatus which can be used to convert tubular blanks containing supplies of flowable desiccant;

FIG. 7 is a fragmentary elevational view of a third apparatus wherein one of the deforming devices serves as a means for ejecting substantially L-shaped frame members from the apparatus.

DESCRIPTION OF PREFERRED EMBODIMENTS

Figure 1:
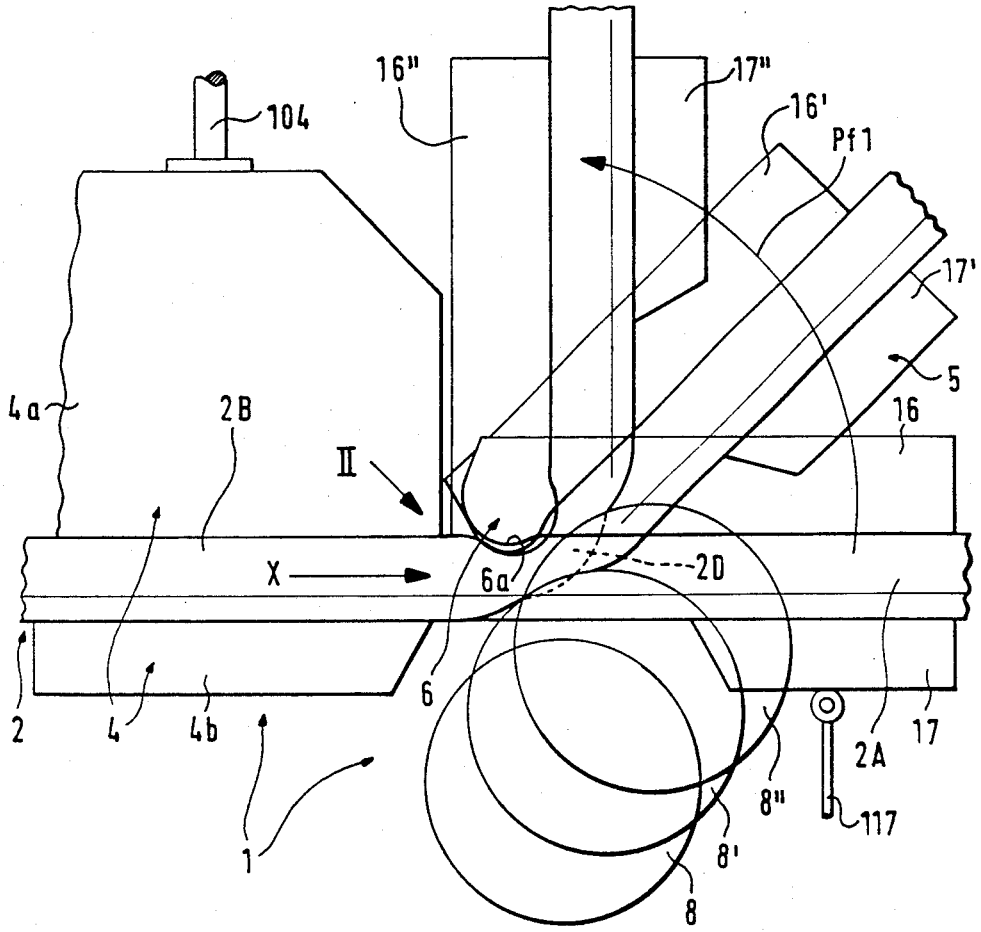
FIG. 1 is a fragmentary schematic elevational view of a portion of an apparatus which embodies one form of the invention, the moving means and the two deforming devices of the means for transforming the intermediate portion of a properly located tubular blank into an elbow or corner being indicated in three different positions.

FIG. 1 shows a portion of an apparatus 1 which serves to convert an elongated tubular blank 2 of ductile material into a substantially L-shaped frame member or body, especially into a part of a spacer frame for use between the panes of a multiple-pane window. Such window is shown, for example, in FIGS. 3 and 7 of commonly owned U.S. Pat. No. 4,627,263 or 4,720,950 to Bayer et al. A blank 2 which is to be converted into a substantially L-shaped frame member or body includes a straight first portion 2A, a straight second portion 2B which is spaced apart from the first portion 2A, and an intermediate portion 2D between the portions 2A, 2B. When the converting operation is completed, the intermediate portion 2D is transformed into a corner or elbow 2E (FIG. 5) and the portions 2A, 2B are then disposed substantially at right angles each other (it being assumed here to that blank 2 will ultimately form part of a square or rectangular spacer frame). The blank 2 can be treated four times so as to form a total of four corners or elbows, and the arrangement may be such that three elbows are formed prior to introduction of a flowable hygroscopic material (desiccant) 3 (note FIGS. 6 and 8) into the interior of the partially completed spacer frame, and such introduction of desiccant precedes the making of the fourth elbow or corner. Reference may be had to the aforementioned commonly owned copending patent application Ser. No. 280,401 filed Dec. 5, 1988. Of course, it is also possible to assemble a rectangular, square or otherwise configurated spacer frame from two or more converted blanks, e.g., of two blanks each of which has two elbows or corners. The ends of such multiple blanks are then sealingly connected to each other, e.g., by resorting to plugs or by injecting a hardenable sealing material into the open ends of the converted blanks.

Figure 2:
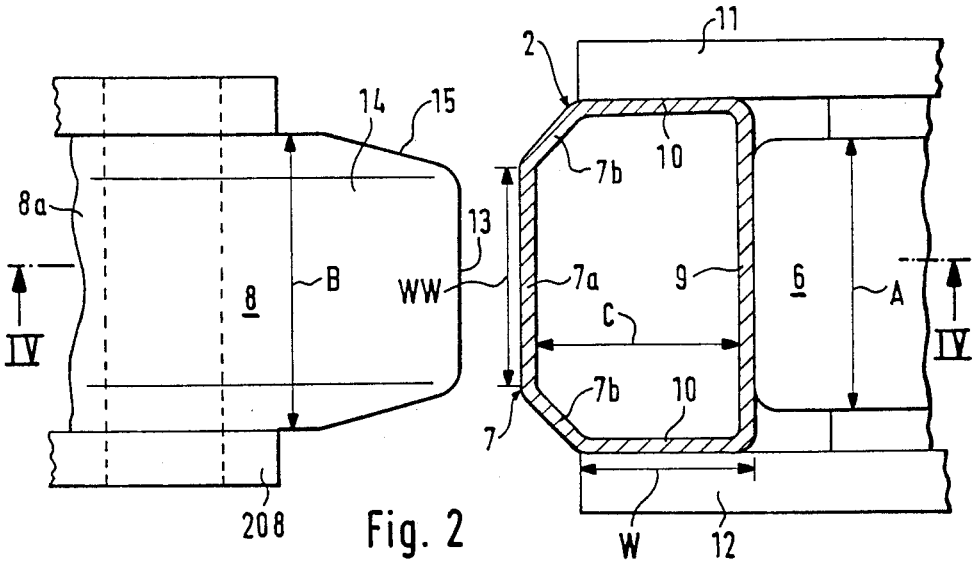
FIG. 2 is an enlarged view of a detail, substantially as seen in the direction of arrow II in FIG. 1, showing the two deforming devices in positions they assume prior to start of a blank transforming operation.

The blank 2 which is to be treated in the apparatus 1 of the present invention can have a cross-sectional outline as shown in FIG. 2, i.e., it can have two spaced-apart parallel sidewalls 10 each having a width W, and two walls 7, 9 which alternate with the sidewalls 10 (as considered in the circumferential direction of the blank 2). The wall 9 is flat, and the wall 7 includes a median portion **7*a* having a width WW, and two lateral portions 7which slope from the respective marginal portions of the median portion 7*a* toward the adjacent sidewalls 10 in a direction toward the wall 9**.

When the intermediate portion 2D of a properly located blank 2 is transformed into an elbow or corner 2E (note FIG. 3), the median portion **7*a* of the wall 7 can actually abut (or is immediately or closely adjacent) the wall 9 so that the profile of the elbow 2E resembles a letter I having a web composed of a median portion of the wall 9 and of median portion 7*a* of the wall 7, a first flange including one of the sidewalls 10, one of the lateral portions 7and one lateral portion of the wall 9, and a second flange including the other sidewall 10, the other lateral portion 7and the other lateral portion of the wall 9**.

The apparatus 1 comprises means for locating a freshly supplied blank 2 so that the intermediate portion 2D of such blank is maintained in a predetermined position (shown in FIG. 1). The locating means is or comprises a clamping unit 4 with two jaws or claws **4*a*, 4*b* at least one of which is movable toward and away from the other jaw or claw so as to engage or release the second portion 2B of the blank 2. For example, the jaw of claw 4*a* can be moved toward and away from the jaw or claw 4*b* by a fluid-operated motor having a reciprocable piston rod 104. The direction in which the blank 2 can be introduced into the apparatus 1** is indicated by arrow X.

The apparatus 1 further comprises means for transforming the intermediate portion 2D of a properly located blank 2 into the aforementioned elbow 2E. Such transforming means includes a first deforming device 6 in the form of an anvil or back support which is located at the outer side of the wall 9 of intermediate portion 2D, a second deforming device 8 in the form of a roller which is disposed at the outer side of the wall 7 of intermediate portion 2D substantially opposite the anvil 6, and a bending element in the form of a jaw or claw 17 forming part of a means 5 for moving the first portion 2A of a properly located blank 2 relative to the second portion 2B so as to bend the intermediate portion 2D about the anvil 6. The anvil 6 is located at the concave or inner side of the freshly formed elbow 2E (see particularly FIG. 5). FIG. 1 shows the bending element of the moving means 5 in a first or starting position 17, in an intermediate position 17′ and a final position 17″. The moving means 5 can further include a linkage, a fluid-operated motor or other suitable means for turning the bending element 17 about the anvil 6 so as to transform the intermediate portion 2D into an elbow 2D. FIG. 1 shows a portion of a link 117 which is coupled to the bending element 17 and can receive motion from a prime mover (not shown) in order to move the bending element between the positions 17 and 17″.

The anvil 6 has an elongated extension 16 which is located opposite the bending element 17 (i.e., the first portion 2A of a properly located blank 2 is located between the bending element 17 and extension 16) and can be said to form part of the moving means 5 because it cooperates with the bending element 17 to properly confine the first portion 2A during transformation of intermediate portion 2D into an elbow 2E.

The apparatus 1 further comprises means for moving the roller 8 relative to the locating means (clamping unit 4) during transformation of the intermediate portion 2D. Three such positions of the roller are shown in FIG. 1, as at 8, 8′ and 8″. The means for moving the roller 8 can be constructed in a manner as disclosed in the aforementioned copending patent application Ser. No. 280,401 filed Dec. 5, 1988. Thus, the roller 8 can be mounted at one end of a lever 208 (FIGS. 2, 3 and 8) which is pivotable about a fixed axis by an eccentric drive or the like while the link 117 moves the bending element of moving means 5 from the position 17 toward the position 17″.

Figure 3:
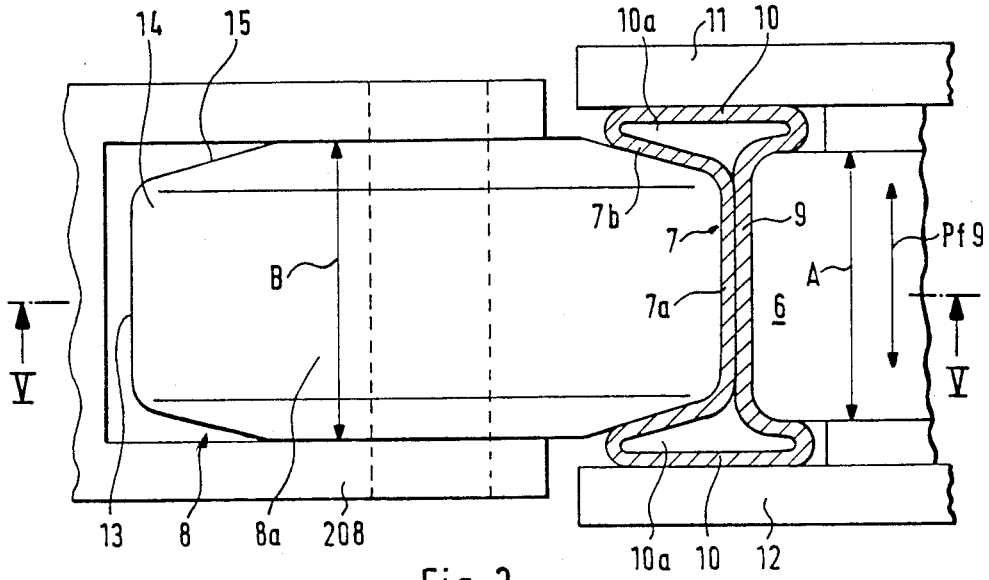
FIG. 3 illustrates the structure of FIG. 2 but with the deforming devices in positions they assume upon completion of the blank transforming operation.

The apparatus 1 also comprises means for displacing at least one of the deforming devices (including the anvil 6 and roller 8) toward the other deforming device, at least during one or more selected stages of transformation of intermediate portion 2D into an elbow 2E. This results in conversion of the profile of intermediate portion 2D from that which is shown in FIG. 2 into that which is shown in FIG. 3, i.e., the median portions of the walls 7 and 9 are forced inwardly toward each other while the mutual spacing of the sidewalls 10 remains at least substantially unchanged. The width or thickness of the thus obtained web including the median portion of the wall 9 and the median portion 7*a* of the wall 7 in the elbow 2E is a small fraction of the width W of a sidewall 10.

The length A of the anvil 6 (as measured in a direction from one of the sidewalls 10 toward the other sidewall) is less than the distance between the sidewalls. It is presently preferred to select the length A of the anvil 6 in such a way that it is at least slightly less than the distance between the sidewalls 10 minus 2m wherein m is the thickness of the wall 7, of the wall 9 or of one of the sidewalls 10 (it is assumed here that the wall thickness of the blank 2 is constant, i.e., that the thickness of one sidewall 10 matches the thickness of the other sidewall 10 and/or the thickness of the wall 7 and/or the thickness of the wall 9). This renders it possible to impart to the elbow 2E a profile of the type shown in FIG. 3, namely with lateral portions of the walls 7, 9 located in the space between the sidewalls 10 and with cavities or compartments 10*a* (e.g., for supplies of desiccant) adjacent the inner sides of the sidewalls 10.

The roller 8 which is shown in FIGS. 2 and 3 has a substantially cylindrical central portion 8*a* with an axial length B which is at least slightly less than the distance between the sidewalls 10, and an annular peripheral portion 14 having an axial length which diminishes in a direction radially outwardly of and away from the cylindrical portion 8*a*. The axial length of peripheral surface 13 of the annular peripheral portion 14 can equal or approximate the width WW of median portion 7*a* of the wall 7. The peripheral surface 13 is flanked by two annular end faces 15 which slope axially and radially toward the respective end faces of the cylindrical portion 8*a*. The radial dimension of the annular peripheral portion 14 (namely from the cylindrical portion 8*a* toward the peripheral surface 15) can exceed the extent to which the median portion 7*a* of the wall 7 is depressed into the space between the sidewalls 10, i.e., portions of the end faces 15 remain exposed when the roller 8 assumes the position of FIG. 3 in which it is disposed at a minimum distance from the anvil 6.

An advantage of the feature which is shown in FIG. 3, namely that the median portions of walls 7 and 9 can actually abut each other in the space between the sidewalls 10, is that this reduces tensional stresses upon the web of the I-shaped profile of the elbow 2E. In fact, the roller 8 can move the median portion 7*a* of the wall 7, and/or the anvil 6 can move the median portion of the wall 9, all the way to or at least into close proximity of the neutral line or chord of intermediate portion 2D. As shown in FIG. 3, the extent to which the median portion 7*a* of the wall 7 is depressed into the space between the sidewalls 10 exceeds the extent of depression of median portion of the wall 9; this is desirable and advantageous because the median portion 7*a* is located at the outer side of the elbow 2E and, therefore, each and every reduction of the radius of curvature of median portion 7*a* contributes to a reduction of tensional stresses in the corresponding part of the elbow 2E.

A deformation of walls 7 and 9 in a manner as shown in FIG. 3 is particularly desirable if the blank 2 is made of a relatively thin ductile sheet material which is readily deformable. Thus, by moving the median portion 7*a* of the wall 7 into direct abutment with the median portion of the wall 9, one greatly reduces the likelihood of uncontrolled stray deformation of intermediate portion 2D during conversion into an elbow 2E. Such controlled transformation of intermediate portion 2D into an elbow 2E of predetermined shape is further enhanced by selecting the dimensions of the anvil 6 and roller 8 in the aforedescribed manner, i.e., so that the annular peripheral portion 14 of the roller 8 can readily enter the space between the sidewalls 10 and the anvil 6 can also cause the median portion of the wall 9 to enter such space with predictable deformation of lateral portions of the wall 9 in the regions of the respective sidewalls 10. In other words, it is desirable (especially if the blank 2 is a thin-walled member) to select the operation of the means for displacing the anvil 6 toward the roller 8 and/or for displacing the roller 8 toward the anvil 6 in such a way that the minimum distance between the two deforming devices equals or closely approximates 2m wherein m is the wall thickness of the blank 2. It often suffices if the distance between the anvil 6 and the roller 8 is reduced to approximately 2m only during one or more selected (e.g., initial and final) stages of transformation of intermediate portion 2D into an elbow 2E. The presently preferred configuration of an elbow 2E is shown in FIG. 5 wherein the roller 8 is omitted for the sake of clarity. It has been found that even very thin-walled intermediate portions 2D can be transformed into elbows 2E of predetermined shape with a high degree of predictability, namely so that their shape matches or closely approximates an optimum shape and also that their appearance is satisfactory for installation between the panes of multiple-pane windows or the like. The walls of elbows are devoid of creases or other defects which would detract from the appearance of spacer frames. Moreover, the number of rejects is negligible.

The elbows which are shown in FIGS. 1, 3, 5, 6 and 7 are devoid of desiccant. If an elbow is to contain a predetermined quantity of desiccant (see FIG. 8), the minimum distance between the roller 8 and anvil 6 can be selected in such a way that the elbow exhibits a preferably flat chamber CH which is disposed between the median portions of the walls 7, 9 and is filled (or at least partially filled) with desiccant. As mentioned above, desiccant can be introduced into the portion 2A and/or 2B of a substantially L-shaped frame member or body upon completion of the transforming operation. The width of the chamber CH for desiccant in an elbow 2E can be a small fraction of the distance C (see FIG. 2) between the walls 7 and 9 prior to start of the blank transforming operation. It is presently preferred to form elbows 2E of the type shown in FIGS. 3 and 5, i.e., wherein the median portions of walls 7 and 9 actually abut or are immediately or very closely adjacent each other so that the elbow cannot or need not contain a supply of desiccant (save in the cavities 10*a* at the inner sides of the sidewalls 10).

FIG. 5 shows that the inward deformation of median portions of the walls 7 and 9 is gradual, i.e., that the median portions of these walls slope gently toward the anvil 6 in a direction from the first portion 2A as well as in a direction from the second portion 2B of the elbow 2E. The roller 8 and the anvil 6 cooperate with two stops 11 and 12 which are outwardly adjacent the sidewalls 10, at least in the region of the anvil 6, so as to ensure that the sidewalls 10 will not bulge outwardly during bending of the walls 7 and 9, even if the walls of the body 2 are very thin. The stop 11 can constitute a relatively large wall or cheek which mounts the locating means 4 as well as the transforming means 5, 6, 8. The arrangement is preferably such that the stop 12 (e.g., a platen which is parallel to the adjacent portion of the stop 11) is movable toward and away from the stop 11 in order to ensure that the improved apparatus 1 can be used for the conversion of different types of blanks 2, namely of blanks with sidewalls 10 disposed at different distances from each other. The means for adjustably mounting the stop 12 on or adjacent the stop 11 for movement toward and away from the stop 11 is indicated in FIG. 3 by a double-headed arrow Pf9. As regards the construction of the stop 11 and of parts which are mounted thereon, reference may be had to the aforementioned copending patent application Ser. No. 280,401 filed Dec. 5, 1988. The stop 12 can be moved away from the stop 11 prior to ejection of an L-shaped frame member or body from the apparatus 1 as well as for convenient introduction of a fresh blank 2.

Figure 8:
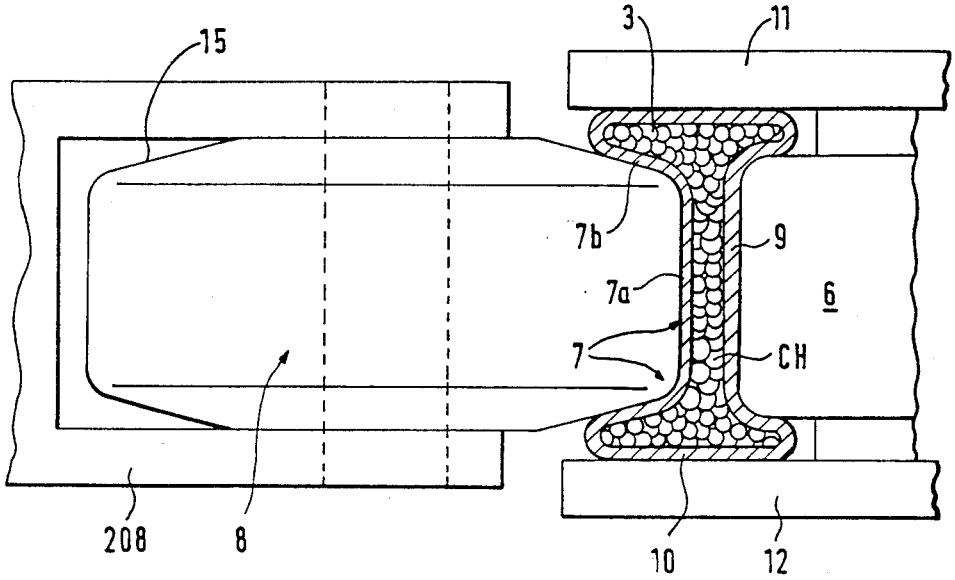
FIG. 8 is a view similar to that of FIG. 3 but showing the making of an elbow which contains a supply of desiccant.

The lateral portions of the walls 7 and 9 in a finished elbow 2E are or can be substantially parallel to each other (note FIGS. 3 and 8). This enhances the appearance of the L-shaped frame member which embodies the elbow 2E, and this even further reduces the likelihood of unpredictable deformation of the walls 7, 9 and 10 during bending of intermediate portion 2D about the anvil 6. Moreover, such design of the deforming devices 6, 8 (namely that they can form elbows of the type shown in FIGS. 3 and 8) renders it possible to impart to arcuate median portions of the walls 7 and 9 very small radii of curvature which is desirable in most spacer frames because the spacer frames are not visible at the corners of the respective multiple-pane windows.

As can be seen in FIGS. 1, 4 and 5, the anvil 6 can be formed with an eccentric protrusion or protuberance 6*a* which projects laterally beyond one side of the extension 16 and penetrates between the adjacent portions of sidewalls 10 during bending of intermediate portion 2D about the anvil. This results in deformation of median portion of the wall 9 so that such median portion moves from the position of FIG. 2 to that which is shown in FIGS. and 5, i.e., the protuberance or protrusion 6*a* determines the concavity of the respective side of the elbow 2E when the transformation of intermediate portion 2D is completed. The extension of the anvil 6 is moved by the moving means 5 so that it travels from the starting position 16, through the intermediate position 16′ and thereupon to the final portion 16″ of FIG. 1 whereby the anvil 6 turns about an axis M (FIGS. 4 and 5) which is normal to the sidewalls 10. This induces the protrusion to move the adjacent part of median portion of the wall 9 into the space between the sidewalls 10, i.e., toward the approaching median portion 7*a* of the wall 7. The recess R which is formed by the protrusion 6*a* of the anvil 6 as a result of turning of the anvil about the axis M is shown in FIG. 5. The depth of this recess depends on the configuration of the peripheral surface of the protrusion 6*a*, i.e., on the eccentricity of this protrusion with reference to the axis M. The lines L denote in FIGS. 4 and 5 different distances of the axis M from various points at the periphery of the eccentric protrusion 6*a*. Such protrusion contributes significantly to predictable transformation of intermediate portions 2D of successively treated blanks 2 into elbows or corners 2E having a predetermined size and shape and being devoid of creases, cracks, breaks and other defects. This highly predictable deformation of the intermediate portion 2D of a blank 2 takes place in the space between the stops 11, 12 which are outwardly adjacent the respective sidewalls 10, the roller 8 which is outwardly adjacent the median portion 7*a* of the wall 7, and the anvil 6 which is outwardly adjacent the median portion of the wall 9.

It is preferred to provide means for releasably (i.e., exchangeably) mounting the anvil 6 and/or the roller 8 on the stop 11. This enhances the versatility of the apparatus 1 because the latter can be rapidly converted for the treatment of differently dimensioned blanks 2 and/or for imparting to blanks 2 of a particular type a desired shape in the regions of their intermediate portions 2D. Replacement of a roller 8 and/or anvil 6 can become necessary as a result of extensive wear, in view of greater or lesser wall thickness of a fresh batch of blanks 2, in view of greater or lesser ductility of the material of a fresh batch of blanks, in view of different configuration of blanks forming a fresh batch and/or because the person in charge desires to impart a different shape to the elbows of converted blanks.

The configuration (particularly the eccentricity) of the protrusion 6a can be selected in such a way that the penetration of protrusion into the adjacent portion of the wall 7 during bending of intermediate portion 2D about the anvil 6 is gradual, i.e., the initial stage of such transformation need not immediately involve a movement of the protrusion 6a toward the roller 8. In other words, the wall 7 will be caused to actually contact the wall 9 when the transformation of intermediate portion 2D into an elbow 2E reaches a selected stage. Such stage is preferably chosen in such a way that, if the walls of the blank 2 are relatively thin, the median portions of the walls 7 and 9 come in actual contact with each other during a relatively early stage of conversion so as to ensure that the abutting median portions of the walls 7 and 9 cooperate in preventing undesirable deformation of intermediate portion 2D during the next-following stage or stages when the material of the intermediate portion is in the process of being subjected to progressively increasing stresses as a result of densification or tensioning of the material of the walls 7 and 9 while the bending element 17 continues to advance toward the final position 17" of FIG. 1.

As can be seen in FIGS. 1, 6 and 7, the anvil 6 can be placed into immediate or close proximity of the locating means 4 to thus even further reduce the likelihood of unpredictable deformation of the walls of intermediate portion 2D during transformation into an elbow 2E. At the same time, the jaws or clamps 4a, 4b of the locating means 4 are free to move relative to each other and/or relative to the anvil 6 and its extension (and vice versa) in order to ensure the making of predictable elbows.

As mentioned above, the extension 16 of the anvil 6 can be said to constitute a component of the moving means 5 in that it cooperates with the bending element 17 in confining the first portion 2A of the blank 2 which is properly located by the locating means 4 so that its intermediate portion 2D is maintained in an optimum position for transformation into an elbow 2E. The direction in which the anvil 6 can turn with the bending element 17 toward the position of FIG. 5 is indicated by arrow Pf1. However, and as will be explained with reference to FIG. 7, the extension 16 of the anvil 6 need not necessarily turn with the bending element 17 of the moving means 5 but can perform instead at least one other desirable and advantageous function, namely of ejecting a finished L-shaped frame member or body from the apparatus 1, preferably in a direction toward the roller 8.

An anvil 6 which turns during deformation of median portion of the wall 9 is desirable and advantageous on the additional ground that the peripheral surface of its eccentric protrusion 6a stretches the material of the wall 9 while the extension moves from the position 16 to the position 16" of FIG. 1. This also contributes to greater predictability of transformation of intermediate portion 2D into an elbow 2E.

FIGS. 6 and 7 illustrate two different modes of controlling the movements of the anvil 6 and roller 8 toward and away from each other for the purpose of ensuring that the median portions of walls 7 and 9 will be forced to enter the space between the sidewalls 10. In the embodiment of FIG. 7, the extension 16 of the anvil 6 is maintained at a fixed acute angle with reference to the second portion 2B of a properly located blank 2. The arrow Pf3 indicates the direction in which the anvil 6 can be moved toward the roller 8 during transformation of intermediate portion 2D into an elbow. The means for moving the anvil 6 and its extension 16 in and counter to the direction which is indicated by arrow Pf3 can include a fluid-operated motor having a piston rod 116 which is coupled to the extension 16. The anvil 6 of FIG. 7 need not be provided with a protrusion, or with a pronounced protrusion, because such anvil can penetrate into the adjacent side of intermediate portion 2D as a result of movement of its extension 16 in the direction of arrow Pf3. Instead, the anvil 6 can have a substantially semicylindrical peripheral outline with an axial length A (FIGS. 2 and 3).

As already mentioned above, the anvil 6 of FIG. 7 can be used as a means for ejecting L-shaped frame members or bodies from the improved apparatus. Thus, the roll 8 can be retracted to the solid-line position of FIG. 7 and the anvil 6 is then moved in the direction of arrow Pf3 (after the stop 12 is moved away from the stop 11) to eject the L-shaped body from the apparatus 1. Alternatively, the apparatus can be equipped with discrete ejecting means in addition to the anvil 6.

FIG. 6 shows that the means for displacing the anvil 6 relative to the roller 8 can comprise a stationary cam having a specially designed cam slot or groove 18 for a follower 19 (e.g., a small roll) on the extension 16 of the anvil. The means 5 for moving the first portion 2A of the blank 2 relative to the second portion 2B so as to bend the intermediate portion 2D about the anvil 6 simultaneously constitutes a means for moving the anvil 6 relative to the cam so that the follower 19 slides in the slot 18 and moves toward and away from the roller 8 during certain predetermined stages of transformation of intermediate portion 2D into an elbow. FIG. 6 shows that the slot or groove 18 has two arcuate sections 18a one of which causes the anvil 6 to move nearer to the roller 8 during an initial stage and the other of which causes the anvil to move nearer to the roller 8 during a later (such as final) stage of transformation of the intermediate portion 2D. The directions in which the pivoting anvil 9 is caused to move relative to the roller 8 in the course of the transforming operation are indicated by a double-headed arrow Pf2.

The displacing means including the cam with slot or groove 18 and the follower 19 can be replaced with other types of displacing means without departing from the spirit of the invention. For example, the bending element 17 of the moving means 5 can carry a cylinder and piston unit with a piston rod coupled to the extension 16 and arranged to perform predetermined movements in response to turning of the bending element 17 about the axis of the anvil so that the anvil moves toward and away from the roller during predetermined stages of transformation of an intermediate portion 2D.

FIG. 6 further shows means for expelling desiccant 3 from the intermediate portion 2D of a blank 2 which contains a supply of desiccant at the time of introduction into the improved apparatus 1 or subsequent to such introduction but prior to conversion of intermediate portion 2D into an elbow. The expelling means can at least limit the quantity of desiccant in the intermediate portion 2D in the course of the blank transforming operation. The improved limiting or expelling means includes a source 120 of pressurized fluid (e.g., a vessel containing a supply of compressed air), and at least one nozzle 20 with one or more orifices arranged to discharge one or more streams or jets of pressurized fluid against the outer side of the wall 9, and more particular against openings 2a which are provided in the wall 9 so as to ensure that the confined desiccant 3 can absorb moisture which penetrates into the space between the panes of a multiple-pane window wherein the panes are held at a fixed distance from each other by a spacer frame produced from a profiled blank 2. Pressurized fluid which is discharged by the nozzle 20 of FIG. 6 impinges upon the wall 9 at an acute angle to the portion 2B of the blank 2 and expels desiccant 3 from the interior of the intermediate portion 2D into the first portion 2A and, at least to a certain extent, into the second portion 2B. This is due to the fact that desiccant which is expelled from 2D into 2A piles up (as at 3*a*) and constitutes a barrier which compels the inflowing fluid to flow toward and into the portion 2B and to thereby cause the formation of another pile 3*b* between the portions 2B and 2D. Thus, the interior of intermediate portion 2D is free of desiccant so that the anvil 6 can cooperate with the roller 8 to impart to the elbow a profile corresponding to that which is shown in FIG. 3, i.e., wherein the walls 7 and 9 actually touch or are immediately adjacent each other.

The nozzle 20 is adjacent or can be incorporated into one jaw of the locating means 4. Its orifice or orifices are closely adjacent the anvil 6.

When the transformation of intermediate portion 2D into an elbow is completed, some of the supply of confined desiccant can flow from the portion 2A and/or 2B into the elbow, e.g., into the cavities 10*a* (note FIG. 3) adjacent the inner sides of the sidewalls 10.

Instead of converting a blank 2 which already contains a supply of desiccant 3, the transformation of intermediate portion 2D into an elbow can be completed prior to introduction of desiccant, particularly in a manner as disclosed in the aforementioned copending patent application Ser. No. 280,401 filed Dec. 5, 1988 which discloses a method of and an apparatus for admitting metered quantities of desiccant into selected portions of a blank which is already provided with several elbows or corners. This copending patent application further discloses that the quantity of admitted desiccant can be selected in such a way that desiccant does not interfere with the making elbows of the type shown in FIG. 3, i.e., wherein the walls 7 and 9 actually contact each other.

An important advantage of the improved apparatus is that the components of its transforming means reliably guide and confine the walls 7, 9 and both sidewalls 10 during the critical phases of transformation of successive intermediate portions 2D into elbows 2E. Moreover, the roller 8 can depress the median portion 7*a* of the adjacent wall 7 so that the radius of curvature of the median portion 7*a* is greatly reduced while the blank transforming operation progresses with the result that the outer wall 7 is unlikely to develop cracks and/or breaks during bending about the wall 9 which, in turn, is being bent around the anvil 6. It has been found that the improved apparatus can effectively and reliably a well as predictably bend thin-walled tubular blanks in such a way that the ultimate shape of each and every portion of a finished elbow matches or closely approximates an optimum shape. Thus, the stops 11 and 12 prevent outward bulging of the sidewalls 10, the anvil 6 moves the adjacent wall 9 nearer the neutral line or chord of the intermediate portion 2D and preferably into actual contact with the median portion 7*a* of the wall 7, and the roller 8 greatly reduces the radius of curvature of median portion 7*a* of the wall 7 while simultaneously moving the median portion 7*a* toward or into actual contact with the median portion of the wall 9. In fact, and as can be seen in FIGS. 3, 5 and 8, even those portions of the elbow 2E which are disposed between and are immediately adjacent the sidewalls 10 assume a predetermined shape so that they can define the cavities 10*a* for reception of required quantities of desiccant. It has been found that the apparatus can convert intermediate portions 2D of a long or short series of blanks 2 into elbows 2E having surprisingly small radii of curvature such as are preferred in all or nearly all types of spacer frames for use in multiple-pane windows or the like. Once the median portions of the walls 7 and 9 actually contact each other, each of these median portions constitutes a guide and a back support for the other median portion so that the walls of the intermediate portion 2D are even less likely to perform any stray movements during the next-following stages of transformation of intermediate portions 2D into elbows 2E. The situation is analogous if the median portions of walls 7 and 9 define a rather flat chamber CH which is filled with desiccant in the course of the blank transforming operation (see FIG. 8). As a rule, or in many instances, desiccants for use in spacer frames have a sandy consistency which is quite satisfactory to prevent undesirable shifting of median portions of the walls 7 and 9 relative to each other once such median portions come in contact with a flat layer of desiccant between them. However, and as mentioned above, it is presently preferred to make elbows 2E as a result of transformation of intermediate portions 2D which are empty (i.e., devoid of desiccant) because this even further enhances the predictability of deforming action which is furnished by the anvil 6 in conjunction with the roller 8 and stops 11, 12. Moreover, absence of any desiccant between the median portions of walls 7 and 9 renders it possible to move such median portions even closer to the neutral line or chord of the intermediate portion 2D so that the wall 9 is subject to less pronounced densification and the wall 7 is subject to less pronounced stretching during bending of such walls about the anvil 6.

The stops 11, 12 constitute an optional but highly desirable and advantageous feature of the improved apparatus.

The configuration of the roller 8 can depart from that which is shown in FIGS. 2, 3 and 8. The illustrated roller 8 is preferred in many instances, especially if the profile of an undeformed blank 2 is identical with or resembles the profile which is shown in FIG. 2, i.e., a profile having a substantially rectangular portion bounded by the wall 9 and sidewalls 10, and a substantially trapeziform portion bounded by the median portion 7*a* and the two lateral portions 7of the wall 7. The annular peripheral portion 14 of the roller 8 is particularly suited to convert the just mentioned trapeziform portion of the profile of a blank 2 into substantially one-half of the profile which is shown in FIG. 3, i.e., into a profile having a web narrower than the sidewalls 10 and two flanges each including one of the sidewalls 10 and the adjacent lateral portions of the walls 7 and 9. As can be readily ascertained on the basis of a comparison of FIGS. 2 and 3, deformation or inward deflection of lateral portions 7*a* of the wall 7 takes place during an advanced stage of movement of the median portion 7*a* of wall 7 toward the wall 9; nevertheless, the deformation of lateral portions 7is highly predictable due to accurate guidance of the median portion 7*b* by the peripheral surface 15 and due to proper confinement of sidewalls 10 by the respective stops 11, 12.

The annular peripheral portion 14 of the roller 8 exhibits the additional important advantage that it prevents excessive (highly pronounced) bending of the blank 2 in the zones of transition between the median portion *7a* and lateral portions 7of the wall 7 as well as in the zones of transition between the lateral portions 7and the sidewalls 10. All this contributes to a reduction of the number of rejects and/or of the making of inferior spacer frames with cracks and/or creases in the region of their elbows.

The feature that the peripheral surface of the anvil 6 determines the exact shape of the concave side of the elbow 2E also contributes to the making of more satisfactory spacer frames. As mentioned above, it suffices if the anvil 6 serves as a means for only temporarily determining the exact shape of the concave side of an elbow 2E, as long as such determination takes place during that stage or during those stages of each blank transforming operation when accurate guidance of the wall 9 (and hence also of the wall 7) is of greatest importance. Moreover, the movability of eccentric protrusion *6a* of the anvil, or of the entire anvil 6, toward the roller 8, at least during certain stages of the blank transforming operation, ensures that (if desired and possible) the median portions of walls 7 and 9 contact each other during a relatively early stage of bending of intermediate portion 2D around the anvil so that the median portions of the walls 7 and 9 are close to the neutral line or chord of the intermediate portion 2D not later than when proper guidance of the walls 7 and 9 is of maximum importance and advantage.

Penetration of an eccentric protrusion *6a* or of a substantially semicylindrical portion of the anvil 6 into the adjacent portion of the blank 6 is optional but desirable and advantageous, especially if the anvil is designed to roll or turn during transformation of an intermediate portion 2D into an elbow. In this manner, the anvil actually rolls into the adjacent portion of the blank to thus ensure smooth and gentle deformation of the adjacent wall 9 from the configuration which is shown in FIG. 2 toward and all the way to that which is shown in FIGS. 3, 5 and 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for converting into a substantially L-shaped body, particularly into a portion of a spacer frame for use in multiple-pane windows, an elongated ductile tabular blank having two spaced-apart walls and two sidewalls alternating with the walls, disposed at a predetermined distance from each other and having a predetermined width, comprising means for locating spaced apart first and second portions of the blank so that an intermediate portion between the first and second portions assumes a predetermined position; and means for transforming the intermediate portion into an elbow, including a first deforming device arranged to engage one wall of the intermediate portion in said predetermined position, a second deforming device arranged to engage the other wall of the intermediate portion in said predetermined position substantially opposite said first device, means for displacing at least one of said devices toward the other of said devices so that the mutual spacing of the walls between said devices is reduced to less than said predetermined width, and means for moving the first portion of the blank relative to the second portion so as to bend the intermediate portion about said first device, at least one of said devices having a length—as measured transversely of the two spaced-apart walls of the blank—less than said predetermined distance so that the elbow which is constituted by the bent intermediate portion has a profile including a web extending between and being narrower than the sidewalls and two flanges each including one sidewall of the intermediate portion.

2. The apparatus of claim 1, wherein said second deforming device includes a roller.

3. The apparatus of claim 1, wherein said displacing means includes means for reducing the distance between said devices to a value such that the walls of the intermediate portion are closely adjacent or touch each other.

4. The apparatus of claim 1 for converting a tubular blank wherein the intermediate portion contains a supply of flowable desiccant, wherein said displacing means includes means for reducing the distance between said devices to a value such that the walls and sidewalls of the intermediate portion define a flat chamber for desiccant.

5. The apparatus of claim 1 for converting a tubular blank having walls and sidewalls of predetermined thickness, wherein the length of said at least one device—as measured transversely of the two spaced-apart walls of the blank—at most equals said predetermined distance minus 2m wherein m is said thickness.

6. The apparatus of claim 1, wherein said second deforming device includes a roller having a substantially cylindrical central portion and an annular peripheral portion the length of which in the axial direction of the roller decreases in a direction radially outwardly from said central portion, the length of said central portion in the axial direction of the roller approximating said predetermined distance and the minimum length of said annular portion being at most equal to said predetermined distance minus 2m wherein m is the thickness of one of said walls.

7. The apparatus of claim 6 for converting a tubular blank wherein the other wall includes a median portion of preselected width and two lateral portions sloping from the median portion toward the sidewalls of the blank, wherein the minimum length of said annular portion equals or approximates said preselected width.

8. The apparatus of claim 6, wherein the width of said annular portion as measured in the radial direction of said roller and of said central portion thereof exceeds the extent to which the other wall of the intermediate portion of the blank is moved toward the one wall in response to displacement of said at least one device toward the other of said devices.

9. The apparatus of claim 1, wherein said first deforming device includes a protrusion arranged to provide the intermediate portion of the blank with a recess in response to bending of the intermediate portion about said first device.

10. The apparatus of claim 1, wherein said first deforming device is exchangeable.

11. The apparatus of claim 1, wherein said displacing means includes means for moving said first deforming device toward said second deforming device.

12. The apparatus of claim 1, wherein said locating means includes a blank clamping unit immediately or closely adjacent said first deforming device.

13. The apparatus of claim 1, wherein said first deforming device includes an extension abutting the first portion of the blank during movement of the first portion relative to the second portion.

14. The apparatus of claim 13, wherein said extension forms part of said moving means.

15. The apparatus of claim 13, wherein said moving means includes a bending element disposed opposite said extension and movable along an arcuate path about said first deforming device while the first portion of the blank is confined between said extension and said bending element.

16. The apparatus of claim 1 for converting a blank having a neutral line between the walls thereof, wherein said displacing means includes means for moving said first deforming device toward said second deforming device substantially to the neutral line of the blank between said devices.

17. The apparatus of claim 1, wherein said first deforming device includes an eccentric protrusion and said displacing means includes means for turning said first device and for thereby moving said protrusion toward said second device whereby the protrusion penetrates into and forms a recess in the intermediate portion of the blank.

18. The apparatus of claim 1, wherein said first deforming device includes an elongated extension which makes an acute angle with the second portion of the blank while the blank is engaged by said locating means, said displacing means including means for moving said extension lengthwise in a direction to reduce the distance between said deforming devices.

19. The apparatus of claim 1, wherein said displacing means includes means for moving said first displacing device relative to the second displacing device during predetermined stages of bending of intermediate portion of the blank about said first device.

20. The apparatus of claim 19, wherein said predetermined stages include an initial stage and a final stage.

21. The apparatus of claim 1, wherein said displacing means includes a cam, follower means provided on said first deforming device and tracking said cam, and means for moving said first device relative to said cam.

22. The apparatus of claim 21, wherein said cam includes first portions nearer to and second portions more distant from said second displacing device.

23. The apparatus of claim 1, further comprising stops flanking the sidewalls of the intermediate portion when the blank is engaged by said locating means.

24. The apparatus of claim 1, wherein said locating means and said transforming means are mounted on one of said stops.

25. The apparatus of claim 23, further comprising means for adjustably mounting one of said stops so as to permit adjustments of the mutual spacing of said stops.

26. The apparatus of claim 1, further comprising means for ejecting the L-shaped body from said locating means.

27. The apparatus of claim 26, wherein said ejecting means includes one of said deforming devices.

28. The apparatus of claim 1 for converting a tubular blank wherein at least one of the first, second and intermediate portions of the blank contains a supply of flowable desiccant, further comprising means for limiting the quantity of desiccant in the intermediate portion of the blank.

29. The apparatus of claim 28 for converting a tubular blank which has openings in the one wall thereof, said limiting means including means for expelling desiccant from the intermediate portion of the blank at least during bending of the intermediate portion about said first deforming device.

30. The apparatus of claim 29, wherein said expelling means includes a source of pressurized fluid and at least one nozzle arranged to admit pressurized fluid into the intermediate portion of the blank by way of said openings.

31. The apparatus of claim 30, wherein said nozzle is adjacent said first deforming device.

32. The apparatus of claim 30, wherein said nozzle is adjacent said locating means.

33. The apparatus of claim 30, wherein said nozzle is arranged to discharge at least one stream of pressurized fluid at an acute angle to the second portion of the blank which is engaged by said locating means.

34. The apparatus of claim 1, wherein said second deforming device includes an exchangeable roller.

* * * * *